US012540544B2

(12) United States Patent
Cargol, Jr. et al.

(10) Patent No.: US 12,540,544 B2
(45) **Date of Patent: *Feb. 3, 2026**

(54) SYSTEM AND PROCESS FOR SUBSEA FIBEROPTIC LOGGING OF A WELL

(71) Applicant: Trendsetter Engineering, Inc., Houston, TX (US)

(72) Inventors: Patrick M. Cargol, Jr., Houston, TX (US); Stephen Kruppa, Houston, TX (US); Edward Street, Houston, TX (US)

(73) Assignee: TRENDSETTER ENGINEERING, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/221,143

(22) Filed: May 28, 2025

(65) Prior Publication Data

US 2025/0290406 A1 Sep. 18, 2025

Related U.S. Application Data

(63) Continuation of application No. 18/991,916, filed on Dec. 23, 2024.

(Continued)

(51) Int. Cl.
*E21B 47/135* (2012.01)
*E21B 33/076* (2006.01)

(Continued)

(52) U.S. Cl.
CPC ..... *E21B 47/135* (2020.05); *E21B 33/076* (2013.01); *E21B 47/001* (2020.05); *E21B 47/01* (2013.01)

(58) Field of Classification Search
CPC ..... E21B 33/076; E21B 47/135; E21B 47/001
See application file for complete search history.

(56) References Cited

U.S. PATENT DOCUMENTS 7,921,919 B2 4/2011 Horton, III
8,020,436 B2 9/2011 Bostick, III (Continued)

OTHER PUBLICATIONS

Well-Sense, "Fibre-Optic Well Surveys," Brochure, dated Nov. 7, 2022, 2-pgs.

(Continued)

*Primary Examiner* — Giovanna Wright
(74) *Attorney, Agent, or Firm* — Cabello Hall Zinda, PLLC

(57) ABSTRACT

A system and process for subsea fiberoptic logging of a well has a subsea structure having a central bore, an upper valve positioned in the central bore, a lower valve positioned on the central bore below the upper valve, and a subsea probe releasably connected to an upper connector of the subsea structure. The subsea structure has at least one channel adapted to connect to a downline. The upper valve is movable between an open position and a closed position. The lower valve is movable between an open position at a lower position. The channel opens to the central bore in an area between the upper valve and a lower valve. The subsea probe has a fiberoptic line connected thereto. The fiberoptic line is adapted to extend to a portion of the central bore of the subsea structure and into the well so as to sense parameters within the well.

30 Claims, 7 Drawing Sheets

Related U.S. Application Data

(60) Provisional application No. 63/616,956, filed on Jan. 2, 2024.

(51) Int. Cl.
*E21B 47/001* (2012.01)
*E21B 47/01* (2012.01)

(56) References Cited

U.S. PATENT DOCUMENTS

| | | | | |
|---|---|---|---|---|
| 8,875,791 | B2 | 11/2014 | Erkol et al. | |
| 9,649,056 | B2 | 5/2017 | Rebec | |
| 9,695,665 | B2 | 7/2017 | Older et al. | |
| 11,161,712 | B2 | 11/2021 | Purkis | |
| 11,168,543 | B2 | 11/2021 | Purkis | |
| 11,193,369 | B2 | 12/2021 | Leblanc et al. | |
| 11,346,172 | B2 | 5/2022 | Purkis | |
| 11,469,823 | B2 | 10/2022 | Purkis | |
| 11,487,037 | B2 | 11/2022 | Therrien et al. | |
| 11,761,282 | B2 | 9/2023 | Purkis | |
| 11,767,754 | B2 | 9/2023 | Kalb et al. | |
| 11,851,964 | B2 | 12/2023 | Purkis | |
| 2004/0020653 | A1 | 2/2004 | Smith | |
| 2008/0272931 | A1 | 11/2008 | Auzerais et al. | |
| 2008/0277122 | A1* | 11/2008 | Tinnen | E21B 23/14 166/339 |
| 2013/0217983 | A1 | 8/2013 | Rebec et al. | |
| 2013/0303869 | A1 | 11/2013 | Rebec et al. | |
| 2017/0204703 | A1 | 7/2017 | Mair | |
| 2019/0010803 | A1 | 1/2019 | Purkis | |
| 2019/0284890 | A1 | 9/2019 | Purkis | |
| 2021/0140310 | A1 | 5/2021 | Kalb et al. | |
| 2022/0060259 | A1* | 2/2022 | Purkis | H04B 10/50 |
| 2022/0416892 | A1 | 12/2022 | Purkis | |
| 2024/0011804 | A1 | 1/2024 | Purkis | |
| 2025/0215790 | A1* | 7/2025 | Cargol, Jr. | E21B 47/01 |

OTHER PUBLICATIONS

Office Action in U.S. Appl. No. 18/991,916 mailed Jul. 29, 2025, 7-pgs.

* cited by examiner

SYSTEM AND PROCESS FOR SUBSEA FIBEROPTIC LOGGING OF A WELL

CROSS-REFERENCE TO RELATED APPLICATIONS

The present application is a continuation of U.S. Non-Provisional application Ser. No. 18/991,916, filed Dec. 23, 2024, which claims priority of U.S. Provisional Patent Application No. 63/616,956, filed on Jan. 2, 2024—both of which are incorporated herein by reference.

FIELD OF THE INVENTION

The present invention relates to the fiberoptic logging of a well. More particularly, the present invention relates to subsea structures which allow for a fiberoptic probe to be delivered into the well. More particularly, the present invention relates to subsea tree injection modules that are adapted to allow fiberoptic lines to be introduced into a subsea well or to a subsea tree.

BACKGROUND OF THE INVENTION

Over the recent past, the search for oil and gas in locations offshore has moved into progressively deeper water. Wells are now commonly drilled at depths of thousands of feet below the surface of the ocean. Additionally, wells are now being drilled in more remote offshore locations. The drilling and maintenance of deep and remote offshore wells is expensive. In an effort to reduce drilling and maintenance expenses, remote offshore wells are oftentimes drilled in clusters. A grouping of wells in a clustered subsea arrangement is sometimes referred to as a "subsea well site". A subsea well site typically includes producing wells completed for production in at least one pay zone. In addition, a well site will often include one or more injection wells to aid in maintaining in-situ pressure for water drive and gas expansion drive reservoirs.

The grouping of subsea wells facilitates the gathering of production fluids into a local production manifold. Fluids from the clustered wells are delivered to the manifold by flowlines called "jumpers". From the manifold, production fluids may be delivered together to a gathering and separating facility for a production line, or "riser". For well sites that are in deeper waters, the gathering facility is typically a floating production storage and offloading vessel.

The clustering of wells also allows for multiple control lines and chemical treatment lines to extend from the ocean surface downwardly to the clustered wells. These lines are commonly bundled into one or more "umbilicals". The umbilical terminates at an "umbilical termination assembly" at the ocean floor. A control line may carry hydraulic fluid used for controlling items of subsea equipment at subsea distribution units, manifolds, and trees. Such control lines allow the actuation of safety valves and other subsea components from the surface. In addition, the umbilical may transmit chemical inhibitors to the ocean floor and then to equipment of the subsea processing system.

Often, a variety of chemicals (also referred to as "additives") are introduced into the production wells and processing units to control, among other things, corrosion, scale, paraffin, emulsions, hydrates, hydrogen sulfide, asphaltens, inorganics and formation of other harmful chemicals. In offshore oilfields, a single offshore platform (e.g., a vessel, a semi-submersible, or a fixed system) can be used to supply these additives to several producing wells.

The equipment used to inject additives includes a chemical supply unit, a chemical injection unit, and a capillary or tubing (also referred to as a "conductor line") that runs from the offshore platform through or along the riser and into the subsea well bore. Preferably, the additive injection system supply precise amounts of additives. It is also desirable for the systems to periodically or continuously monitor the actual amount of the additives being dispensed, determine the impact of the dispersed additives, and vary the amount of the additives as needed to maintain certain desired parameters of interest within their respectively desired ranges or at their desired values.

Coiled tubing has been increasingly used in the subsea environment. Coiled tubing can easily be placed upon large reels so that hundreds of feet of tubing can be easily deployed to the offshore location. In the past, coiled tubing has served a variety of purposes in delivering and removing fluids from the subsea environment. However, the coiled tubing has not seen great applicability in delivering and injecting chemicals into the subsea structure, such as a Christmas tree, or for the transmitting of control signals to the subsea tree. One of the problems associated with such coiled tubing is the possibility of damage created when extreme forces are applied to the tubing. If the tubing were to be disconnected by force from the subsea structure, damage to the subsea structure could occur, and a resulting environmental event could also occur.

Referring to FIG. 1, there is shown a subsea tree injection module 10 in accordance with the teachings of U.S. Pat. No. 9,695,665, issued on Jul. 4, 2017 to the present Applicant. This subsea tree injection module 10 includes a subsea structure 12. The subsea structure can be in the nature of a subsea tree or a well. A manifold 14 is positioned on a mandrel 13 extending upwardly from the subsea structure 12. The manifold is connected by a hose 16 to a first disconnect mechanism 20. A first coiled tubing 22 is connected to the disconnect mechanism 20 and extends upwardly toward a surface location. Another hose 24 is connected to the manifold 14 and extends outwardly therefrom. The second hose 24 is connected to a second disconnect mechanism 26. A second coiled tubing 28 is also connected to the second disconnect mechanism 26 and extends upwardly to a surface location. A jumper 30 is also connected to the manifold 14 and connected to the subsea structure 12. Jumper 30 is intended to pass fluids, along with control signals, from the manifold 14 to and from the surface location to the subsea structure 12.

The manifold 14 is intended to collect fluids and chemicals as passed therein to the hoses 16 and 24. The manifold 14 will then deliver the fluid to the subsea structure 12 through the jumper 30. Importantly, the first hose 16 can include an electrical line 32 that extends from the first disconnect mechanism 20 along the hose 16 and to the manifold 14. Similarly, another electrical line 34 can extend from the second disconnect mechanism 26 along the hose 24 to the manifold 14. The manifold can include a control module (not shown) therein that is connected to the electrical lines 32 and 34. The control module within the interior of the manifold 14 is intended to provide control signals to the subsea structure 12 and to the disconnect mechanisms 20 and 26. Additionally, the first coiled tubing 22 and the second coiled tubing 28 can also include the electrical lines that are connected to electrical lines 32 and 34, respectively, so that signals from the surface location can be passed to the control module or received from the control module.

The first coiled tubing 22 and the second coiled tubing 28 can be deployed from a vessel at a surface location. The first coiled tubing 22 terminates at the disconnect mechanism 20. The second coiled tubing 28 terminates at the second disconnect mechanism 26. The coiled tubing 22 and 28 will hang in the water column some distance above the subsea structure 12. The flexible hoses 16 and 24 can include an electrical flying lead that connects the disconnect mechanisms 20 and 26 to the manifold 14. The manifold 14 ties in at least one coiled tubing and, preferably, two or more coiled tubing systems together so as to direct the fluid to the jumper 30 and the subsea structure 12. Electrical power and control signals are delivered to the subsea chemical injection system, as well as the subsea structure 12, via an electrical line attached to the coiled tubing 22 and 24, to the disconnect mechanisms 20 and 26, and to the manifold 14. The necessary power and control signals required to control the subsea chemical injection system and to control the subsea tree injection module 10 are directed into the control module located in the manifold 14. The power and signals required to control the subsea structure 12 are simply passed directly therethrough.

Hydraulic power is supplied to the subsea tree injection module 10 via two methods. The primary method utilizes the low-pressure supply found in the production umbilical system. This low-pressure supply can be fed to the manifold 14 from the production umbilical by a hot stab flying lead connected to a junction plate interface unit. This junction plate interface unit is installed between the production flying lead and the subsea structure 12. The second method for providing hydraulic power to the subsea chemical injection system 10 is through the use of accumulators located within the manifold 14. These accumulators provide only limited functionality before the stored pressure will need to be recharged.

Many industries, such as the oil and gas industry, require the deployment of elongated media, such as optical fibers, within a bore, for example, a wellbore. This facilitates applications such as communication, sensing, and the like. In some examples, it may be desirable to deploy electrical conductors in a bore. However, there are many benefits to deploying optical fibers in bores. These optical fibers can facilitate sensing operations, such as distributed temperature sensing, distributed pressure sensing, and distributed acoustic sensing. Optical fibers can be strong, light, compact and cost-effective. Optical fibers may also be used for data communication to or from a bore. In many wellbore applications, the optical fiber is deployed as an integral component of a completion string and thus may be classified as a permanent installation. The cost of including a permanently installed optical fiber system can be significant. There are also some concerns over the longevity of such permanently-installed systems.

Fiber line intervention systems represent a revolution in approach, using low-cost disposable downhole tools that utilize optical fibers. Devices that can be deployed in a bore can include systems such as sensors and such systems can be active or passive. Active systems can provide a wider range of options and operations that generally require power supply, such as a battery and a means for communicating data, such as sensor data, operating commands, and parameters, between the device downhole and a surface location. Such means for communicating data can often be expensive, overly complex, bulky and lack the necessary robustness.

In the past, these fiberline intervention systems have been developed by Well-Sense Technology Limited. FIG. 2 shows a prior art fiberline intervention system developed by Well-Sense Technology and described in U.S. Patent Application Publication No. 2022/0416892, published on Dec. 29, 2022.

In FIG. 2, the prior art fiberline intervention tool 40 is particularly illustrated. FIG. 2 shows the prior art fiberline intervention tool 40 in a cross-section, while FIG. 3 shows the fiberline intervention tool 40 in a wellbore. The fiberline intervention tool 40 comprises a frame or housing 42 comprising a container 44 mounted thereon. The container 44 is packaged in a first configuration with a fiberoptic deployable member 47. The fiberoptic deployable member 47 is arranged to be deployable from this first configuration upon deployment of the fiberline intervention tool 40 within a wellbore (as shown in FIG. 3).

The fiberline intervention tool 40 further comprises a first disposable tool 46. The disposable tool 46 can be any suitable form of passive or active tool, such as a data logger or other sensing device. For example, the first disposable tool 46 may be an active tool that comprises a controller 45 and is connectable to one or more devices, such as sensors, for collecting data, such as environmental data, wellbore data, fluid flow data, formation data and/or tool data that is coupled to the controller 45. These other devices are not limited to sensors and may be other suitable operational devices, such as valves, actuators, and/or the like.

The first disposable tool 46 is mounted to the frame 42 of the fiberline intervention tool 40. The first disposable tool 46 comprises a generally cylindrical housing 49 defining a hollow interior 50 and end plates 52 for closing the hollow interior. The hollow interior 50 may be filled with any suitable material, including a readily disposable material for adding weight, as may be required. Examples of suitable materials can include natural materials, such as sand, rock and rock flour and/or artificial materials, such as iron filings, liquid metal, dissolved plastic beads and the (like generally indicated in the volume 51). At least one of the end plates 52 may be removably mountable to the housing 49 to allow ready opening of the first disposable tool 46 so that it may be filled with a suitable disposable material to add weight to the first disposable tool 46. Different materials may be used depending on the overall desired weight. The housing 49 and the end plates 52 may be made of the disposable material, such as a low-cost plastic material. The housing 49 and the end plates may be made of a dissolvable material, such as dissolvable plastic material which may dissolved in water and/or oil. The selection of the precise plastic material can depend upon the conditions of the well and/or the types of fluids contained in the well. If the well contains water, then water-soluble material may be used for the housing 49 and/or the end plates 52 of the first disposable tool 46. If the well contains hydrocarbons, then an oil-soluble material may be used for the housing 49 and/or the end plates 52 of the first disposable tool 46.

The fiberline intervention tool 40, as shown in FIG. 2, is equipped with a fiberoptic line 47. Other types of deployable members can also be provided in addition to the fiberoptic line 47. The fiberoptic line 47 can include one or more lines made from various fibers. The fiberoptic line 47 provides data and/or signal communications and can also provide mechanical support for the fiberline intervention tool 40. The fiberoptic line 47 can be spooled around a bobbin or spool. Various methods or techniques can be used to control deployment or unintentional unwinding of the deployment member 47. For example, a wax, burnished, lacquer, grease or other material with semi-sticky properties can be applied on the loaded fiberline intervention tool to keep the fiberline intervention tool 40 from deploying unintentionally. The fiberoptic line 47 can also include an electrical component so as to provide support for control, power, and/or data communications.

FIG. 3 shows an application of the fiberline intervention tool 40 as deployed within a wellbore 41. Tubular 58 is a diagrammatic simplified illustration of a wellhead region and comprises a device 54, such as a lubricator or stuffing box for entering the wellbore device inside the wellhead. The device 54 can also be a ball or dart launcher, a deployment head, or other suitable devices for entering the fiberline intervention tool 40 inside the wellhead.

The fiberline intervention tool 40, as shown in FIG. 3, may be deployed within the wellbore via gravity. The first disposable tool 46 can confirm clear passage to a given depth for other tools, such as intervention tools that may follow. As the fiberline intervention tool 40 is being deployed into the well, the fiberoptic line 47 is also deployed. The fiberoptic line 47 may be released and allowed to remain in the well. The fiberline intervention tool 40 can be employed to drift and log the wellbore at the same time. Accordingly, a first region, such as a first end of the fiberoptic line 47, may be operably connected to a fiberoptic surface module 56. The fiberoptic surface module 56 comprises a surface transmitter comprising a light source and a surface receiver (such as an interrogator). Any suitable fiberoptic module may also be used including distributed temperature sensing, distributed pressure sensing, or distributed acoustic sensing modules. These are all commercially available from a number of suppliers. For example, if a distributed temperature sensing module is used, the temperature of the optical fiber at all locations along its length may be measured from the surface. The temperature profile of the well may be logged either during deployment or during retrieval of the fiberoptic line 47. The fiberline intervention tool 40 can also include one or more sensors or other devices that are required to convey data to the surface module 56.

FIG. 4 shows a different type of fiberline intervention tool 60 in accordance with the teachings of U.S. Patent Application Publication No. 2019/0284890, published on Sep. 19, 2019 in the prior art. FIG. 4 shows the fiber line intervention tool 60 deployed within a wellbore 62. The fiberline intervention tool 60 includes a spool 64 for the fiberoptic line 66. As the fiberline intervention tool 60 traverses the wellbore 62, the fiberoptic line 66 is deployed from an exit 68 at the trailing end of the fiberline intervention tool 60. To that end, the fiber line 66 may be considered to be stowed at the fiberline intervention tool 60 in a first wound configuration and arranged to be deployed from the fiberline intervention tool 60 into a second unwound configuration within a well. The fiberoptic line 66 can be used during or after deployment for multiple applications, such as communications. In some examples, the fiberoptic line 66 may be used for distributed sensing within the wellbore 62. This can include distributed temperature sensing, distributed pressure sensing, distributed acoustic sensing, or the like. A point sensor 70 is located at one end of the fiberline intervention tool 60. Point sensor 70 is in the nature of an inverted conical member and serves to help centralize the fiberline intervention tool 60 within the wellbore 62.

A significant problem occurs where the fiberline intervention tool is desired to be employed, but a subsea tree injection module (as shown in FIG. 1) is employed on the wellhead or on the subsea tree. Typically, there would be no clear path in which the fiberline intervention tool can be employed so as to secure data from the well. As such, a need has developed so as to modify the subsea tree injection module (shown in FIG. 1) so as to accommodate the release of the fiberline intervention tool into the well associated with the wellhead or the subsea tree.

In the past, various patents and patent application publications have issued with respect to the use of fiberoptics for the measurement of parameters within a well. For example, U.S. Pat. No. 7,921,919, issued on Apr. 12, 2011 to E. E. Horton, describes a subsea well control system and method. The system comprises a surface installation in a position above a plurality of subsea wells disposed within a watch circle of a surface installation. A plurality of flowlines directly couples at least one of the plurality of subsea wells to the surface installation. The control station, hydraulic power unit, and an injection unit are disposed on the surface installation. A distribution body is disposed on the seafloor and is coupled to each of the control station, the hydraulic power unit, and the injection unit via one or more umbilicals. The first wellhead component is disposed on one of the subsea wells and is coupled to the distribution body via one or more flying leads that provide electrical, hydraulic, and fluid communication. A second wellhead component is disposed on another one of the subsea wells and coupled to the distribution body via one or more flying leads the provides electrical, hydraulic, and fluid communication. The control station is operable to provide control functions to the first and second wellhead components during drilling, workover, and production activities.

U.S. Pat. No. 8,020,436, issued on Sep. 20, 2011 the W. X. Bostick, shows a permanently installed in-well fiberoptic accelerometer-based sensing apparatus. A multi-station, multi-component system is adapted to conduct seismic reservoir imaging and monitoring in a well. Permanent seismic surveys can be conducted using time-lapse vertical seismic profiling and extended micro-seismic monitoring.

U.S. Pat. No. 8,875,791, issued on Nov. 4, 2014 to Erkol et al., provides a segmented fiberoptic coiled tubing assembly of multiple segments. The assembly is assembled from multiple coiled tubing segments which are pre-loaded with a fiberoptic line. The coupling mechanism is employed for physical coupling of the coiled tubing segments as well as communicative coupling of the lines of the separate segments to one another.

U.S. Pat. No. 11,193,369, issued on Dec. 7, 2021 to Leblanc et al., shows an in-line amplifier assembly for distributed sensing systems. A distributed sensing tool is deployed in a wellbore. The wellbore is logged using the distributed sensing tool. The distributed sensing tool includes a first optical amplifier and a first optical filter coupled to a first single-mode optical fiber. The first optical amplifier is coupled to a first single-mode circulator for amplifying a single-mode optical signal. The first optical fiber is coupled to the first optical amplifier for filtering the amplified single-mode optical signal.

U.S. Pat. No. 11,487,037, issued on Nov. 1, 2022 to Therrien et al., describes a production monitoring system that includes a distributed acoustic sensing subsystem that has a first optical fiber for distributed acoustic sensing and the distributed temperature sensing subsystem that includes a second optical fiber. The production monitoring system includes a cable positioned at a wellbore penetrating through the subterranean formation. The distributed acoustic sensing subsystem is communicatively coupled to the cable to the distributed temperature sensing subsystem.

U.S. Pat. No. 11,767,754, issued on Sep. 26, 2023 to Kalb et al., teaches a downhole fiberoptic transmission for real-time well monitoring and downhole equipment actuation. The subsea wellhead system includes a tubing hanger landed in a wellhead. The tubing hanger has a first fiberoptic cable. A tree is landed on the tubing hanger, and a transducer is disposed at a downhole location. The tree comprises a second fiberoptic cable. The first fiberoptic cable is communicatively coupled to the transducer and extends between the transducer and the seal sub. The seal sub is landed in the tubing hanger. The seal sub includes a first fiberoptic communications line that is communicatively coupled to the first fiberoptic cable and the second fiberoptic cable. The seal sub and the tubing hanger form an electrical connection regardless of an orientation of the tubing hanger relative to the tree.

U.S. Patent Application Publication No. 2004/0020653, published on Feb. 5, 2040 to D. R. Smith, provides a method and apparatus to monitor, control and log subsea oil and gas wells. This method allows logging tools, wire rope, optical fibers, electrical cables, monitoring and measuring instruments, and other items to be disposed into the well without interfering with the flow path through the production string. An instrument pod is moored or tethered over the subsea well. The instrument pod is designed to provide on-board data storage, data processing, data receiving and data transmission equipment, such that the data from the well can be transmitted back to a receiving network. The data can be stored and processed as useful information for reservoir operators.

U.S. Patent Application Publication No. 2008/0272931, published on Nov. 6, 2008 to Auzerais et al., provides a method and apparatus for measuring parameters within a well. This system includes a first apparatus having a first reel of a first wound fiberoptic line and at least one sensor able to measure the parameter of the well. The information on this parameter can be transmitted through the first optical fiber. A second apparatus includes a second reel of a wound optical fiber that is able to unwind from a second reel. An extremity of the second optical fiber is fixed to a reference point. A light transmitter or receiver device is linked to the reference point and is able to generate or detect a light pulse through the second optical fiber line. There is a means to exchange the light pulse between the first and second optical fibers.

U.S. Patent Application Publication No. 2021/0140310, published on May 13, 2021 to Kalb et al., discloses a system and method for real-time monitoring of well conditions and actuation of downhole equipment. The subsea wellhead system includes a tubing hanger landed on a wellhead. The tubing hanger includes a first fiberoptic cable, and a tree is landed on the tubing hanger. The tree has a second fiberoptic cable. A transducer is disposed at a downhole location. The first fiberoptic cable is communicatively coupled to the transducer and extends between the transducer and the seal sub. The seal sub is landed in the tubing hanger. The seal sub includes a first fiberoptic communications line that is communicatively coupled to the first fiberoptic cable and the second fiberoptic cable. The seal sub and the tubing hanger form an electrical connection regardless of an orientation of the tubing hanger relative to the tree.

SUMMARY OF THE INVENTION

It is an object of the present invention to provide a system and process for subsea fiberoptic logging which allows for the deployment and operation of a fiberoptic well logging tool in a subsea environment.

It is another object of the present invention to provide a system and process for the subsea fiberoptic logging which allows for real-time logging to a surface location.

It is another object of the present invention to provide a system and process for subsea fiberoptic logging which allows for data logging to be obtained subsea.

It is another object of the present invention to provide a system and process for subsea fiberoptic logging that facilitates subsea deployment and operation of a fiberoptic logging unit.

It is another object of the present invention to provide a system and process for subsea fiberoptic logging that provides the ability to conduct multiple deployments without recovering of the subsea structure to the surface.

It is another object of the present invention to provide a system and process for subsea fiberoptic logging which allows a subsea probe to be installed by a remotely-operated vehicle.

It is another object of the present invention to provide a system and process for subsea fiberoptic logging that provides the ability to change out the subsea probe in a quick, convenient, and easy manner.

It is a further object of the present invention to provide a system and process for subsea fiberoptic logging which allows for distributed pressure measurements sensing, distributed temperature sensing and distributed acoustic sensing within the well.

It is a further object of the present invention to provide a system and process for subsea fiberoptic logging which provides a rich well profile and a monitoring of changing conditions, irregularities, anomalies, or events.

It is still a further object of the present invention to provide a system and process for subsea fiberoptic logging which is adaptable to a subsea tree injection module mounted upon a wellhead or upon a subsea tree.

These and other objects and advantages of the present invention will become apparent from a reading of the attached specification and appended claims.

The present invention is a system for subsea fiberoptic logging of a well. The system includes a subsea structure having a central bore, an upper valve positioned on the central bore below an upper connector of the subsea structure, a lower valve positioned on the central bore below the upper valve, and a subsea probe releasably affixed to the upper connector of the subsea structure. The subsea structure has a lower connector at an end of the subsea structure opposite the upper connector. The subsea structure has at least one channel adapted to connect to a downline. The upper valve is movable between an open position and a closed position. The lower valve is also movable between an open position and a closed position. The channel opens to the central bore in an area between the upper valve and the lower valve. The subsea probe has a fiberoptic line connected thereto. This fiberoptic line is adapted to extend through a portion of the central bore of the subsea structure and into the well so as to sense parameters within the well.

The channel has an upper end positioned at or adjacent to a top of the subsea structure. The upper end of the channel is adapted to connect with the downline. The downline is, in particular, a length of coiled tubing. A passageway extends from the central bore or from the upper connector to the channel. The subsea probe has a housing receiving a portion of the fiberoptic line. The housing is separable from the subsea probe and is adapted to flow through the passageway to the channel. The housing and the fiberoptic line are extendable to the bottom of the well.

In the present invention, the subsea probe includes a connector releasably affixed to the upper connector of the subsea structure. A housing is releasably affixed to this connector and extends into a portion of the central bore of the subsea structure. The housing receives a portion of the fiberoptic line therein. The connector of the subsea probe has an interface at an outer surface thereof. The interface connects with the fiberoptic line. The interface is adapted to allow measurements from the fiberoptic line to be transmitted or transported to a surface location. The fiberoptic line has a probe tip positioned at or adjacent to a bottom of the housing. The probe tip is a single point sensor.

In one embodiment of the present invention, the subsea structure is a subsea tree injection module. A subsea tree has a connector at an upper end thereof. The lower connector of the subsea tree injection module is affixed to the connector of the subsea tree. Alternatively, there is a wellhead positioned on the surface location of a top of the well. The lower connector of the subsea structure is affixed to the wellhead. A subsea data acquisition unit is connected to or cooperative with the fiberoptic line. The subsea data acquisition unit is adapted to receive and process data received from the fiberoptic line.

The present invention is also a process for obtaining data from a fiberoptic line in a well. This process includes the steps of: (1) affixing the connector to a surface of the subsea structure such that the housing and the portion of the fiberoptic line extend into the central bore of the subsea structure; (2) releasing the housing from the connector such that the connector flows into the central bore of the subsea structure; (3) traveling the housing and the fiberoptic line from the central bore of the subsea structure and into the well; and (4) taking measurements from the fiberoptic line when the fiberoptic line is in the well.

The connector or the central bore has a passageway extending to the channel. A liquid flows into and through the channel and the lower valve is open such that the flowing liquid passes toward the well. The housing is released so as to flow through the passageway to the channel into the central bore in an area between the upper valve and the lower valve. The channel has a coiled tubing extending to a reservoir of liquid. A valve can be open to the channel so as to allow the liquid from the reservoir to flow into the central bore. The upper valve is opened while the lower valve is closed such that the liquid flows through the upper valve and into and through the passageway such that the housing and the portion of the fiberoptic line flows into the channel. The upper valve can be closed after the housing is released so as to stop fluid flow when the housing passes into the channel.

The lower valve is closed so as to shear the fiberoptic line such that the housing and the portion of the fiberoptic line remain at the bottom of the well. The connector is released from the subsea structure after the step of taking measurements. In particular, the upper valve is closed prior to the step of releasing the connector. The connector is actuated so as to separate the connector from a connector of the subsea structure. In the preferred embodiment of the present invention, the subsea structure is a subsea tree injection module that is adapted to connect to a subsea tree or to a wellhead.

This foregoing Section is intended to describe, with particularity, the preferred embodiments of the present invention. It is understood that modifications to this preferred embodiment can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
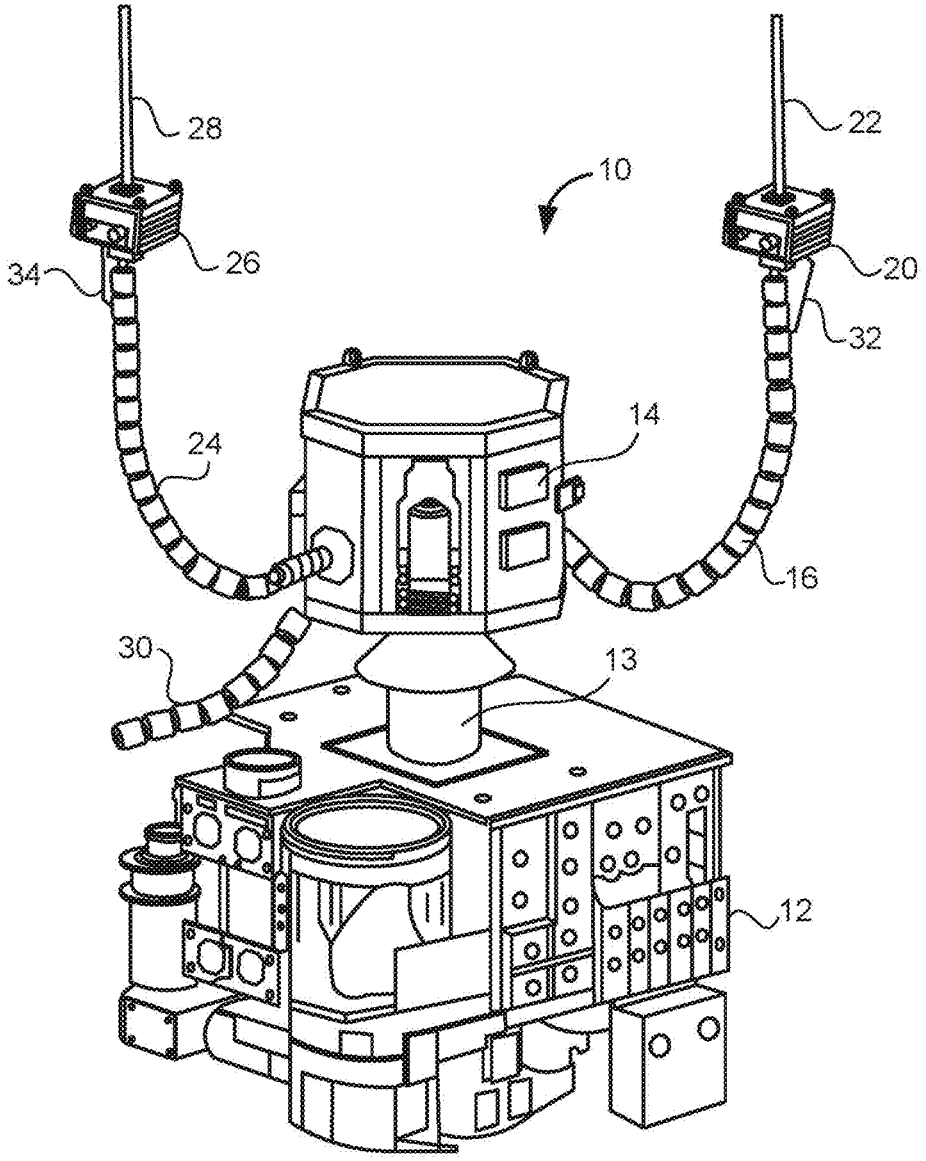
FIG. 1 PRIOR ART
FIG. 1 is an upper perspective view showing a subsea injection module of the prior art.
Figure 5:
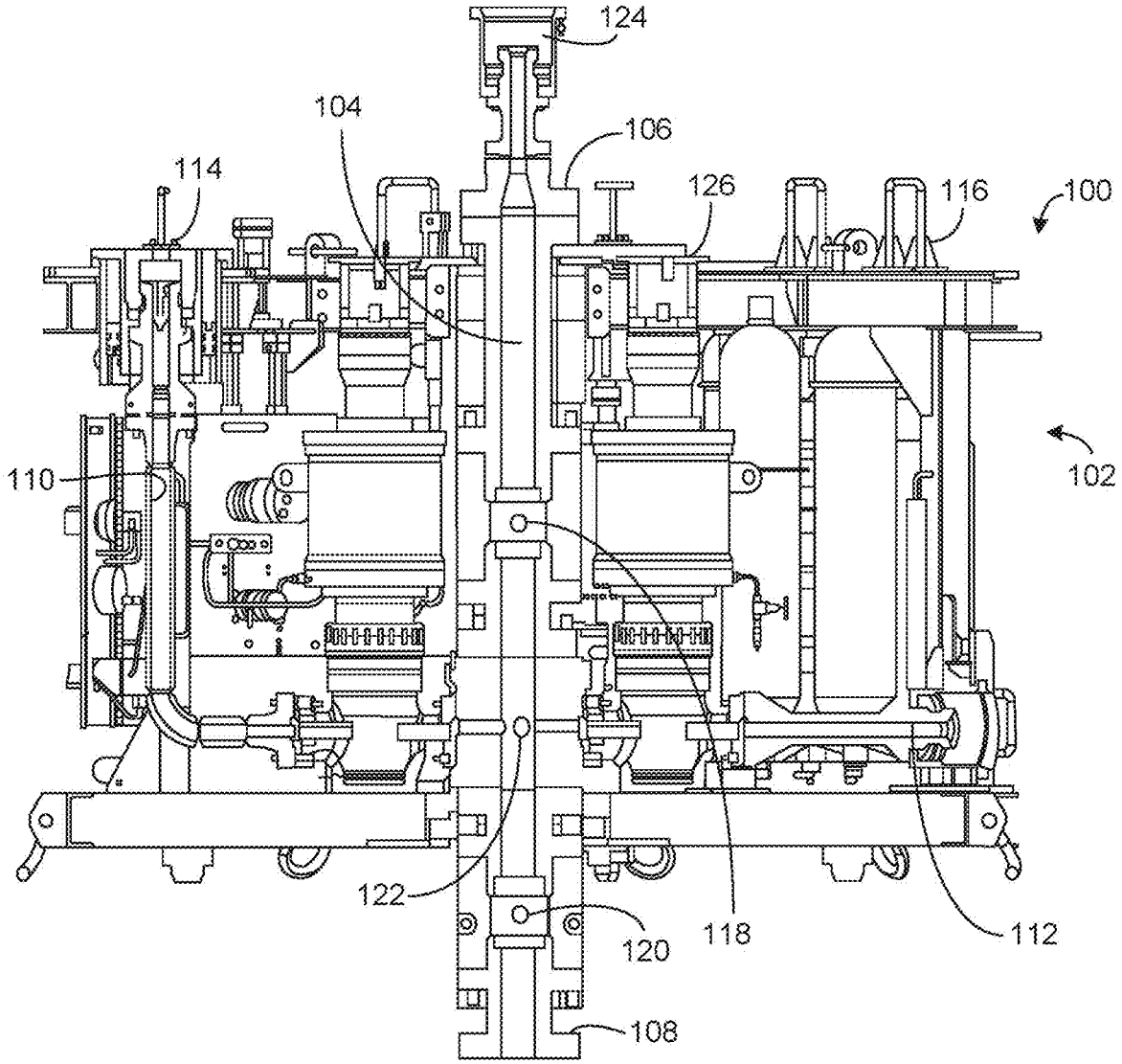
FIG. 5 is a side elevational view, in partial cross-section, of the subsea tree injection module of FIG. 1 with modifications for the receipt of a fiberoptic probe of the present invention.

FIG. 5 shows a system 100 for subsea fiberoptic logging for a well. In particular, a subsea tree injection module 102 is particularly illustrated. This subsea tree injection module 102 is the "subsea structure" in accordance with the claims of the present invention. The subsea tree injection module 102 generally has the configuration of the subsea tree injection module 10 as illustrated in FIG. 1. However, there are variety of modifications to the subsea tree injection module 102 particularly adapted to the system 100 of the present invention. In particular, the subsea tree injection module 102 includes a central bore 104. Central bore 104 can be in the nature of a lubricator bore. The subsea tree injection module 102 includes an upper connector 106 and a lower connector 108. The subsea tree injection module 102 further includes a first channel 110 and a second channel 112. Channel 110 has an upper end 114 adapted to be connected to a downline (not shown). Similarly, the second channel 112 has an upper connector 116 adapted to be connected to a downline (not shown).

An upper valve 118 is positioned on the central bore 104 below the upper connector 106. This upper valve 118 is movable between an open position and a closed position. A lower valve 120 is positioned on the central bore 104 below the upper valve 118. The lower valve 120 is movable between an open position and a closed position. The channels 110 and 112 will open to the central bore 104 in an area 122 between the upper valve 118 and the lower valve 120.

Figure 7:
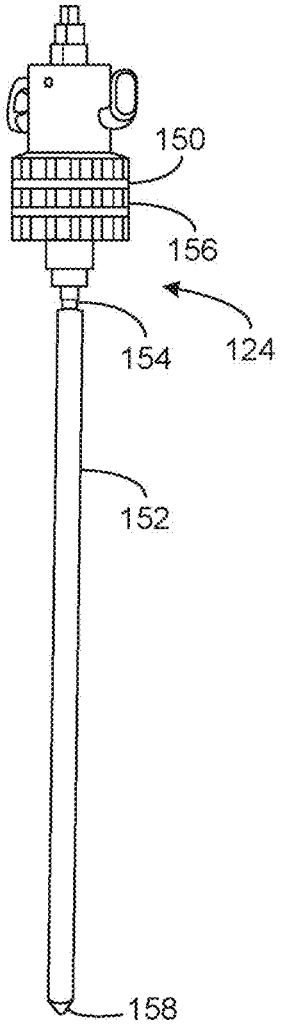
FIG. 7 is a side elevational view of the fiberoptic probe of the present invention.

A subsea probe (124; FIG. 7) is releasably affixed to the upper connector 106 of the subsea tree injection module 102. This subsea probe (124) will have the fiberoptic line connected thereto (as shown in the following drawings). This fiberoptic line is adapted to extend through a portion of the central bore 104 and into the well so as to sense parameters within the well. The connector 106 can be a TC2V inboard hub. The upper valve 118 and the lower valve 120 are ball valves.

The first channel 110 has an upper end positioned at or adjacent to the top 126 of the subsea tree injection module 102. The upper end of the first channel 110 is adapted to connect with a downline (not shown). This downline can be a length of coiled tubing.

Figure 6:
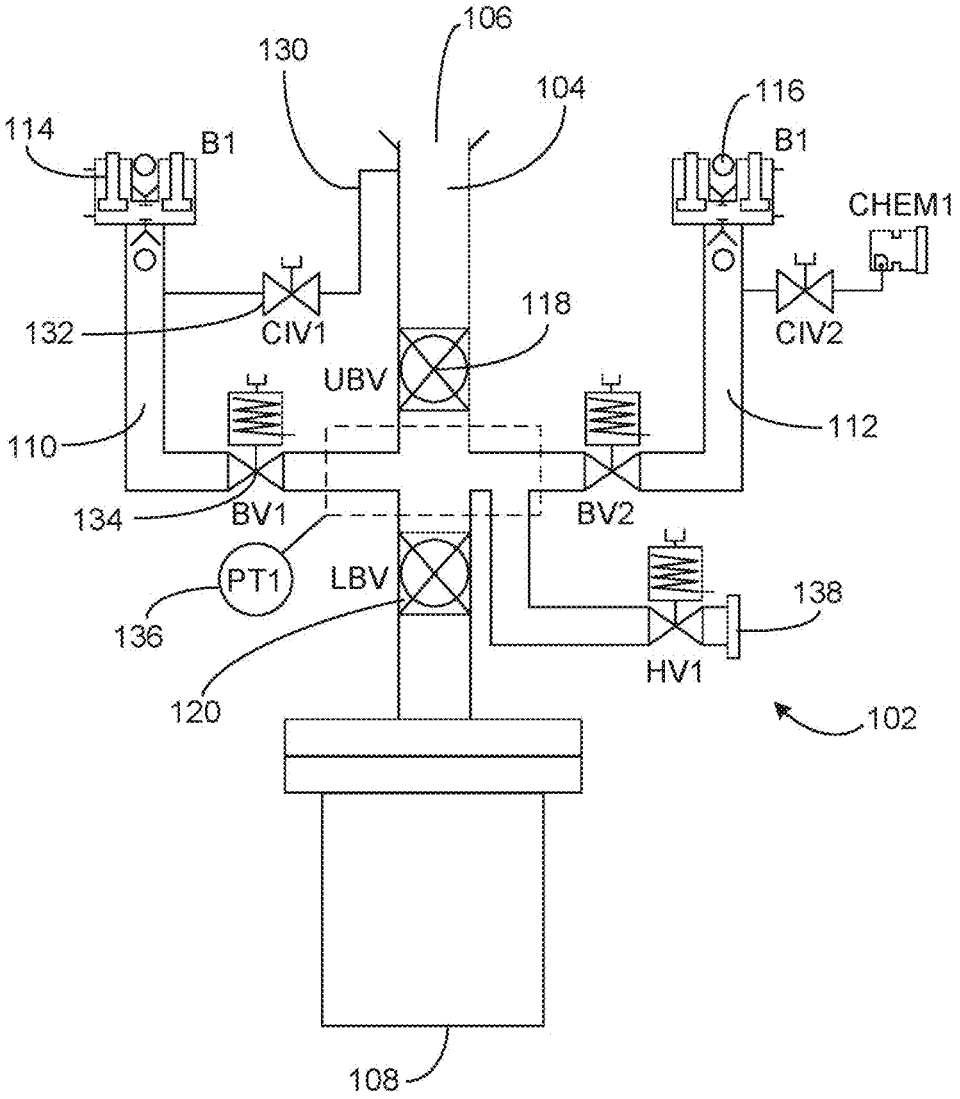
FIG. 6 is a schematic illustration of the components of the subsea tree injection module of the present invention as adapted for the receipt of the fiberoptic probe.

As will be described hereinafter, a passageway (130; FIG. 6) extends from the central bore 104 or from the upper connector 106 to the first channel 110. The subsea probe (124) will have a housing receiving at least a portion of the fiberoptic line. The housing will be separable from the subsea probe (124) and adapted to flow through the passageway into the channel 110 (or into and through the channel 112). The subsea tree injection module 102 is adapted to be connected to the subsea tree by the lower connector 108. In particular, the subsea tree will have an upper connector that is adapted to engage the lower connector 108. Alternatively, the subsea tree injection module 102 can be connected to a wellhead positioned at a subsea location at the top of the well. The lower connector 108 of the subsea tree injection module 102 can be affixed to this wellhead.

FIG. 6 is a schematic illustration of the construction of the system 100, as shown in FIG. 5. In particular, the central bore 104 extends vertically within the subsea tree injection module 102 and has the upper valve 118 and the lower valve 120 positioned therein. The passage 130 extends from the central bore 104 toward the first channel 110. A check valve 132 is positioned on the passage 130 so as to allow for a unidirectional flow of liquid, such as water or hydrocarbons, from the central bore 104 to pass to the first channel 110. A ball valve 134 is positioned on the first channel 110 so as to be movable between an open position and a closed position.

The second channel 112 is illustrated as extending outwardly from the central bore 104. The second channel 112 includes an upper connector 116 that is adapted to be connected to a downline (not shown). Similarly, the first channel 110 includes upper connector 114 is adapted to be connected to another downline (not shown). The downlines can be in the nature of coiled tubing arranged so as to deliver liquids into and through the channels 110 and 112, respectively. The passageway 130 is in the nature of a lubricator flushing line. A pressure transducer 136 is provided in communication with the central bore 104 and/or the first channel 110 and the second channel 112. A flush line 138 can be mounted outwardly of the second channel 112 so as to remove liquids from the central bore 104 and/or the channels 110 and 112, as required. The central bore 104 will be affixed to the upper connector 106. The central bore 104 will also have the lower connector 108 at a bottom thereof.

FIG. 7 illustrates the subsea probe 124 as used with the subsea tree injection module 102 of the system 100 of the present invention. In particular, the subsea probe 124 includes a connector 150 that is releasably affixed to the upper connector 106 of the subsea tree injection module 102. A housing 152 is releasably affixed to the connector 150 and extends into a portion of the central bore 104 of the subsea tree injection module 102. The housing 152 will receive a portion of the fiberoptic line 154 therein. The connector 150 of the subsea probe 124 has an interface 156 at an outer surface thereof. This interface 156 connects with the fiberoptic line 154. The interface 156 is adapted to allow measurements from the fiberoptic line 154 to be transmitted or transported to a surface location. In particular, the interface 156 can be a wet mate fiberoptic connector for a hydraulic probe release stab. As such, the data received by the fiberoptic line 154 from the well (in accordance with the teachings provided in the Background herein) can be transmitted. The connector 150 is a TC2V connector. The connector 150 can be a plug-and-play adapter that can be easily received within the connector (106; FIG. 5) of the subsea tree injection module (102). A point sensor probe 158 can be located at the end of the housing 152 and the end of the fiberoptic line 154 opposite the connector 156.

Figure 8:
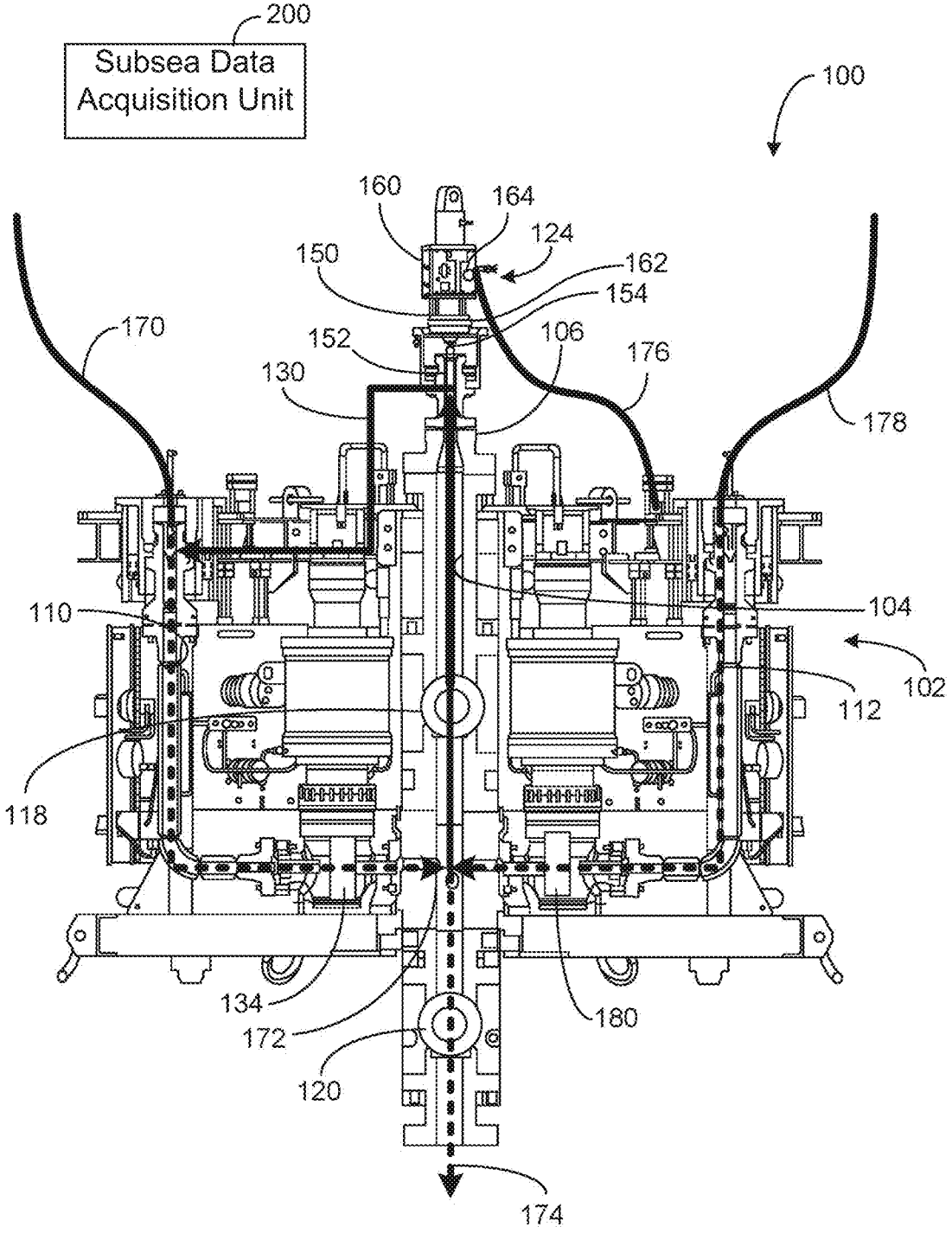
FIG. 8 is a flow diagram showing, in particular, the flow of fluids within the subsea tree injection module and showing the deployment of the fiberoptic probe.

In normal use as shown in FIG. 8, a remotely operated vehicle (not shown) can manipulate the subsea probe 124 into position adjacent to the subsea tree injection module 102. It can be loaded into the connector 106 so that the housing 152 (along with the attached fiberoptic line) can be installed into the central bore 104 in a location above the first valve 118. Suitable and known hydraulic head catches can be used so as to lock the subsea probe 124 into a proper position. This provides the flexibility to change out the subsea probe 124 in a manner similar to that of a subsea pig launcher. This allows for multiple deployments of the fiberline intervention system without recovery of the subsea tree injection module 102. The subsea probe 124 includes a fiberoptic interface 164, a probe head catch 160, and a TC2V connector 162 as a single unit. The subsea probe 124 is mated to the primary controls of the subsea tree injection module 102 through a wet mate connector with an electrical flying lead and a hydraulic flying lead of a harness 176.

Figure 2:
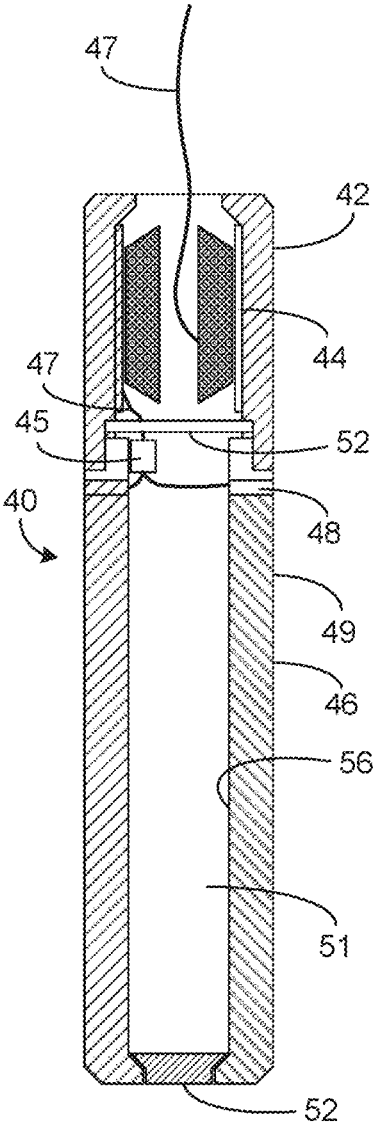
FIG. 2 PRIOR ART
FIG. 2 is a cross-sectional view of a fiberoptic probe of the prior art.
Figure 3:
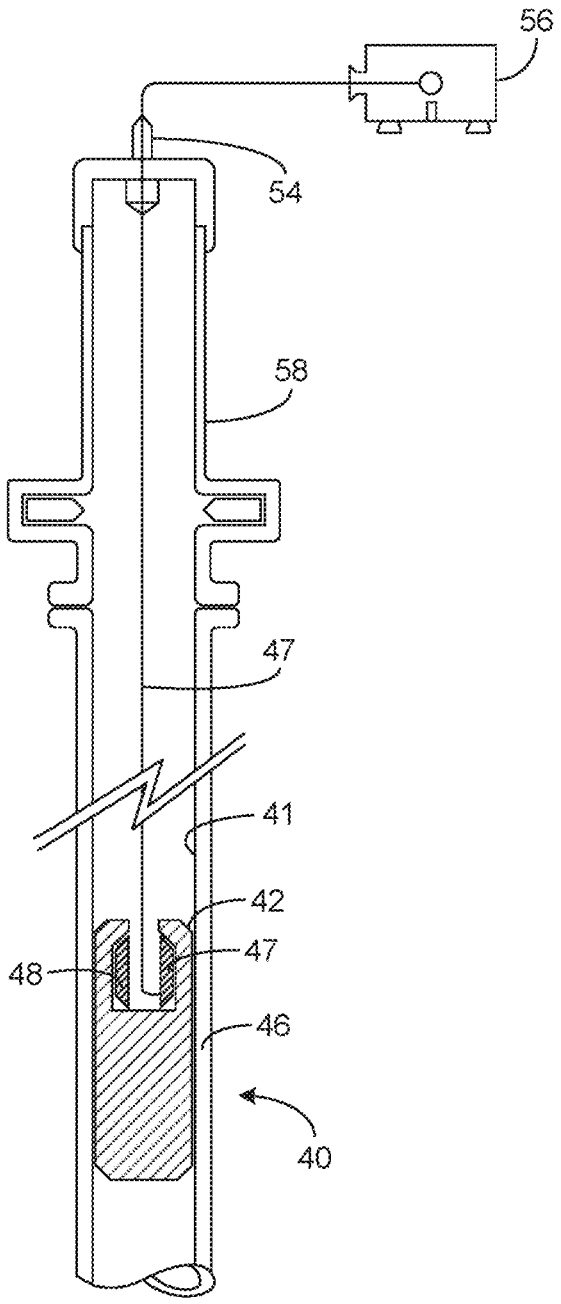
FIG. 3 PRIOR ART
FIG. 3 is a cross-sectional view of a fiberoptic probe of the prior art as deployed within a well and connected to processing equipment.
Figure 4:
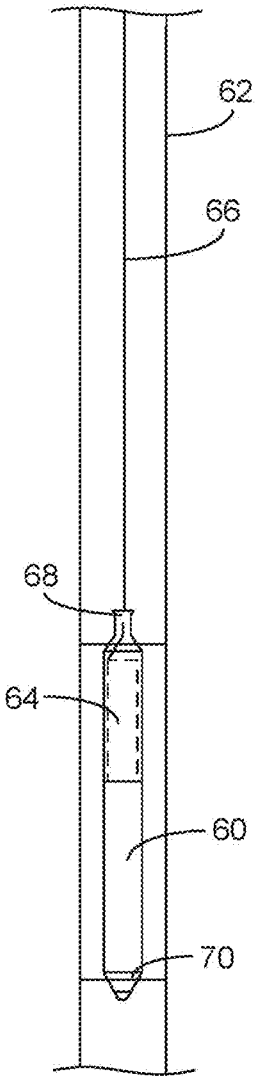
FIG. 4 PRIOR ART
FIG. 4 illustrates the fiberoptic probe of another embodiment of the prior art as installed within a wellbore.

FIG. 8 is an illustration of the process of the system 100 in accordance with the teachings of the present invention. The process allows for obtaining data from a fiberoptic line in a well. The fiberoptic line will have a portion received in a housing 152 in the nature of that shown in FIG. 7 and in association with FIGS. 2-4 herein. Again, the housing 152 is detachably connected to a connector 150 of the subsea probe 124. The connector 150 is connected to the upper connector 106 of the subsea tree injection module 102. The subsea tree injection module 102 has the central bore 104 with the upper valve 118 and the lower valve 120. The subsea tree injection module 102 has at least one channel 110 connected to the central bore 104.

In the process of the present invention, the connector 150 of the subsea probe 124 is connected to the upper connector 106 of the subsea tree injection module 102. As such, the housing 152 and a portion of the fiberoptic line 154 extend into the central bore 104 of the subsea tree injection module 102. The housing 152 is released from the connector 150 such that the housing 152 flows into the central bore 104 of the subsea tree injection module 102. The housing 152 and the fiberoptic line 154 travel from the central bore 104 ultimately into the well. Measurements can then be taken from the fiberoptic line 154 when the fiberoptic line is in the well. In particular, in the process of the present invention, the connector 150 of the subsea probe 124 or the upper connector 106 of the subsea tree injection module 102 has the passageway 130 that extends to the first channel 110. A liquid flows into and through the first channel 110 as provided by the downline 170. Downline 170 is a length of coiled tubing that extends to a subsea location or a surface location where a reservoir of the liquid is stored. The lower valve 120 is opened such that the flowing liquid passes toward the well. The housing 152 of the subsea probe 124 is released so as to flow through the passageway 132, the channel 110 and to the central bore 104 into an area between the upper connector 116 and into an area 172 between the upper valve 118 and the lower valve 120. The valve 134 on the first channel 110 is open so as to allow the liquid from the reservoir to flow through the downline 170, through the first channel 110, and toward the central bore 104. The upper valve 118 is opened while the lower valve 120 is closed such that the liquid flows through the upper valve 118 and into and through the passage 130 such that the housing 152 and a portion of the fiberoptic line 154 flows into the first channel 110. The upper valve 118 is then closed after the housing 152 is released so as to stop the flow when the housing 152 passes into the channel 110. In this manner, the housing 152 and the fiberoptic line 154 will flow through the first channel 110, will enter the central bore 104 below the upper valve 118, will flow through the lower valve 120 and into the well 174. A harness 176 is illustrated as connecting the subsea probe 124 to the subsea tree injection module 102. The second channel 112 is illustrated as connected to another downline 178. Valve 180 can be opened and closed so as to allow the liquid from the downline 178 to flow through the second channel 112 and into the central bore 104. When the liquid is flowing in the downlines 170 and 178 and through the respective channels 110 of 112 (and the valves 134 and 180 are open), this flow will cause the liquid to flow upwardly in the central bore 104 and through the upper valve 118 (when the upper valve 118 is opened). This serves to facilitate the flow of the liquid into and through the passageway 130 in order to allow for flow around the housing 152 and the fiberoptic line 154 to enter the passageway 130 and ultimately travel in the manner of the arrows in FIG. 8 back to the central bore 104 below the upper valve 118.

A remotely operated vehicle is used to install the subsea probe 124 onto the subsea tree injection module 102 and to mate with the electrical flying lead and the hydraulic flying lead. The central bore 104 (or lubricator) is pressure tested and flushed through the use of the downlines 170 and 178 in the manner described herein previously. Ultimately, the valve 118 is closed and the valve 120 is opened so that the stimulation fluid is pumped through the downlines 170 and 178 and through the subsea tree injection module 102. The subsea probe 124 is released through the control system for the fiberoptic line 154. Ultimately, the fiberoptic line 154 unspools from the subsea probe 124 as the housing 152 and the fiberoptic line 154 fall to the bottom of the well. This unspooling is in the manner described herein previously in association with the embodiment of the present invention shown in FIGS. 2 and 3. The acquired data is transmitted through the electrical flying lead, to the remotely-operated vehicle, or stored in a subsea data acquisition unit 200.

Ultimately, after the data is acquired from the well, the lower valve 120 is closed so as to shear the fiberoptic line 154. The housing 152, along with a portion of fiberoptic line 154, will remain on the bottom of the well. Ultimately, because of the materials used for the formation of the housing 152 and the fiberoptic line 154, the pieces will dissolve over time. Ultimately, the connector 150 of the subsea probe 124 is disconnected from the connector 106. The harness 176 is also disconnected. This allows for the recovery of the subsea probe 124 since the lower valve 120 is closed during this procedure, no fluids will escape from the central bore 104 or from the passageway 130. A remotely-operated vehicle will disconnect the control harness 176 and unlock the subsea probe 124 from the subsea tree injection module 102.

The present invention allows distributed temperature sensing to occur. The distributed temperature sensing measures the temperature along the fiberoptic line 154 at one-meter intervals along the length simultaneously in order to record changes as a function of time. This allows for warmback monitoring following stimulation or injection, locating of thief zones, the locating of out-of-zone injection, and the determination of tubing fluid movement and tubing leaks. The present invention further allows for distributed acoustic sensing. The distributed acoustic sensing measurements recorded along the length of the fiberoptic line 154. This conveys different information in different frequency bands. High-frequency acoustics can be detected a few centimeters from a sound source. Low frequencies can travel for many meters. This distributed acoustic sensing allows for the determination of the point of origin. For low frequencies of between 0 and 4 Hz, fracture activity, casing strain, and seismic and micro-seismic events can be determined. For medium frequencies of between 4 and 100 Hz, flow past obstacles and behind tubing flow can be determined. The high frequencies of greater than 100 Hz will allow for the location of gas leaks, gas lift valve (GLV) flow, and tubing leaks. Pressure measurement can be deployed within the fiberline intervention probe and the bottom hole pressure measurement transmitted back to the surface along the fiberoptic line. Surface readout can be provided using a simple receiver and laptop. This allows for production optimization, the evaluation of reserves, the enhanced recovery planning, plug and abandonment (P&A) planning, and downtime (DT).

The foregoing disclosure and description of the invention is illustrative and explanatory thereof. Various changes in the details of the illustrated construction can be made is the scope of the present invention without departing from the true spirit of the invention. The present invention should only be limited by the following claims and their legal equivalents.

The invention claimed is:

1. A system for sensing in a subsea well, the system comprising:

a subsea structure mounted in communication with the subsea well, the subsea structure defining a bore and defining at least one flow channel, the bore defined through the subsea structure and communicating with the subsea well, the at least one flow channel configured to connect at least one downline to a channel area in the bore, the subsea structure comprising a first valve and a second valve; and a subsea probe mounted in communication with the bore of the subsea structure and including a fiberoptic line, the fiberoptic line being deployable from the subsea probe through the bore of the subsea structure and into the subsea well and being configured to conduct optical signals for sensing data associated with the subsea well, wherein the first valve is positioned in the bore between the subsea probe and the channel area and is operable between open and closed conditions; and wherein the second valve is positioned in the bore between the channel area and the subsea well and is operable between open and closed conditions separately from the first valve.

2. A system for sensing in a subsea well, the system comprising:

a subsea structure mounted in communication with the subsea well, the subsea structure defining a bore and defining at least one flow channel, the bore defined through the subsea structure and communicating with the subsea well, the at least one flow channel configured to connect at least one downline to a channel area in the bore, the subsea structure comprising at least one valve positioned in the bore and being operable between open and closed conditions; and a subsea probe mounted in communication with the bore of the subsea structure and including a fiberoptic line, the fiberoptic line being deployable from the subsea probe through the bore of the subsea structure and into the subsea well and being configured to conduct optical signals for sensing data associated with the subsea well, wherein the subsea structure defines a lubricator line communicating a first location of the bore between the subsea probe and the at least one valve with a second location of the at least one flow channel; and wherein the subsea structure comprises a control valve disposed on the lubricator line and being operable to open and close fluid communication through the lubricator line.

3. A system or sensing in a subsea well, the system comprising:

a subsea structure mounted in communication with the subsea well, the subsea structure defining a bore and defining at least one flow channel, the bore defined through the subsea structure and communicating with the subsea well, the at least one flow channel configured to connect at least one downline to a channel area in the bore, the subsea structure comprising a control valve disposed on the at least one flow channel and being operable to open and close fluid communication between the at least one flow channel and the bore; and a subsea probe mounted in communication with the bore of the subsea structure and including a fiberoptic line, the fiberoptic line being deployable from the subsea probe through the bore of the subsea structure and into the subsea well and being configured to conduct optical signals for sensing data associated with the subsea well.

4. The system of claim 3, wherein the subsea structure comprises at least one valve positioned in the bore and being operable between open and closed conditions.

5. A system for sensing in a subsea well, the system comprising:

a subsea structure mounted in communication with the subsea well, the subsea structure defining a bore and defining at least one flow channel, the bore defined through the subsea structure and communicating with the subsea well, the at least one flow channel configured to connect at least one downline to a channel area in the bore, wherein the subsea structure comprises a first connector and at least one valve, the first connector communicating with the bore, the at least one valve positioned in the bore between the channel area and the first connector and being operable between open and closed conditions; and a subsea probe mounted in communication with the bore of the subsea structure and including a fiberoptic line, the fiberoptic line being deployable from the subsea probe through the bore of the subsea structure and into the subsea well and being configured to conduct optical signals for sensing data associated with the subsea well, wherein the subsea probe comprises a second connector being configured to releasably connect to the first connector.

6. The system of claim 5, wherein the at least one valve comprises:

a first valve positioned in the bore between the subsea probe and the channel area; and a second valve positioned in the bore between the channel area and the subsea well, the second valve being operable between open and closed conditions separately from the first valve.

7. A system for sensing in a subsea well, the system comprising:

a subsea structure mounted in communication with the subsea well, the subsea structure having a first connector, a first valve, and a second valve, the subsea structure defining a bore and at least one flow channel, the bore defined through the subsea structure and communicating the first connector with the subsea well, the at least one flow channel configured to connect at least one downline to a channel area in the bore, the first valve positioned in the bore between the first connector and the channel area and being operable between open and closed conditions, the second valve positioned in the bore between the channel area and the subsea well and being operable between open and closed conditions separately from the first valve; and a subsea probe including a second connector and a fiberoptic line, the second connector being configured to releasably connect to the first connector, the fiberoptic line being deployable from the subsea probe through the bore of the subsea structure and into the subsea well and being configured to conduct optical signals for sensing data associated with the subsea well.

8. The system of claim 7, wherein the subsea probe comprises an interface in communication with the fiberoptic line, the interface being configured to communicate the optical signals with the fiberoptic line.

9. The system of claim 7, wherein the subsea structure is a subsea tree injection module, a third connector of the subsea tree injection module being configured to connect to a subsea connector of a subsea tree.

10. The system of claim 7, wherein the subsea structure comprises a third connector configured to connect to a wellhead positioned on the subsea well.

11. The system of claim 7, further comprising a data acquisition unit in communication with the subsea probe, the data acquisition unit being configured to acquire the data sensed with the fiberoptic line.

12. A system for sensing in a subsea well, the system comprising:

a subsea structure mounted in communication with the subsea well, the subsea structure having a first connector and at least one valve, the subsea structure defining a bore and at least one flow channel, the bore defined through the subsea structure and communicating the first connector with the subsea well, the at least one flow channel configured to connect at least one downline to a channel area in the bore, the at least one valve positioned in the bore and being operable between open and closed conditions, wherein the subsea structure defines a lubricator line communicating a first location of the bore between the first connector and the at least one valve with a second location of the at least one flow channel; and a subsea probe including a second connector and a fiberoptic line, the second connector being configured to releasably connect to the first connector, the fiberoptic line being deployable from the subsea probe through the bore of the subsea structure and into the subsea well and being configured to conduct optical signals for sensing data associated with the subsea well.

13. The system of claim 12, wherein the at least one valve comprises:

a first valve positioned in the bore between the first connector and the channel area; and a second valve positioned in the bore between the channel area and the subsea well, the second valve being operable between open and closed conditions separately from the first valve, wherein the lubricator line communicates the first location of the bore between the first connector and the first valve with the second location of the at least one flow channel.

14. The system of claim 12, further comprising a control valve disposed on the lubricator line and being operable to open and close fluid communication through the lubricator line.

15. A system for sensing in a subsea well, the system comprising:

a subsea structure mounted in communication with the subsea well, the subsea structure having a first connector and at least one valve, the subsea structure defining a bore and at least one flow channel, the bore defined through the subsea structure and communicating the first connector with the subsea well, the at least one flow channel configured to connect at least one downline to a channel area in the bore, the at least one valve positioned in the bore and being operable between open and closed conditions, the subsea structure comprising a control valve disposed on the at least one flow channel and being operable to open and close fluid communication between the at least one flow channel and the bore; and a subsea probe including a second connector and a fiberoptic line, the second connector being configured to releasably connect to the first connector, the fiberoptic line being deployable from the subsea probe through the bore of the subsea structure and into the subsea well and being configured to conduct optical signals for sensing data associated with the subsea well.

16. A system for sensing in a subsea well, the system comprising:

a subsea structure mounted in communication with the subsea well, the subsea structure having a first connector and at least one valve, the subsea structure defining a bore and at least one flow channel, the bore defined through the subsea structure and communicating the first connector with the subsea well, the at least one flow channel configured to connect at least one downline to a channel area in the bore, the at least one valve positioned in the bore and being operable between open and closed conditions; and a subsea probe including a second connector and a fiberoptic line, the second connector being configured to releasably connect to the first connector, the fiberoptic line being deployable from the subsea probe through the bore of the subsea structure and into the subsea well and being configured to conduct optical signals for sensing data associated with the subsea well, wherein the subsea probe comprises a deployable housing having the fiberoptic line connected thereto, the deployable housing being releasable from the subsea probe and being deployable through the bore of the subsea structure to the subsea well, the fiberoptic line being unspoolable from the subsea probe.

17. A system for sensing in a subsea well, the system comprising:

a subsea structure mounted in communication with the subsea well, the subsea structure having a first connector and at least one valve, the subsea structure defining a bore and at least one flow channel, the bore defined through the subsea structure and communicating the first connector with the subsea well, the at least one flow channel configured to connect at least one downline to a channel area in the bore, the at least one valve positioned in the bore and being operable between open and closed conditions; and a subsea probe including a second connector and a fiberoptic line, the second connector being configured to releasably connect to the first connector, the fiberoptic line being deployable from the subsea probe through the bore of the subsea structure and into the subsea well and being configured to conduct optical signals for sensing data associated with the subsea well, wherein the subsea probe comprises a deployable housing having a portion of the fiberoptic line housed therein, the deployable housing being releasable from the subsea probe and being deployable through the bore of the subsea structure to the subsea well, the fiberoptic line being unspoolable from the deployable housing.

18. The system of claim 17, wherein the deployable housing comprises a sensor connected to the fiberoptic line.

19. The system of claim 17, wherein the subsea probe comprises:

a head catch having a launcher; and a probe connector disposed on the head catch and being configured to releasably connect to the first connector of the subsea structure, the deployable housing extending from the probe connector and being insertable into a portion of the bore of the subsea structure, the deployable housing being releasable from the launcher.

20. A system for sensing in a subsea well, the system comprising:

a subsea structure mounted in communication with the subsea well, the subsea structure having a first connector and at least one valve, the subsea structure defining a bore and at least one flow channel, the bore defined through the subsea structure and communicating the first connector with the subsea well, the at least one flow channel configured to connect at least one downline to a channel area in the bore, the at least one valve positioned in the bore and being operable between open and closed conditions; and a subsea probe including a second connector and a fiberoptic line, the second connector being configured to releasably connect to the first connector, the fiberoptic line being deployable from the subsea probe through the bore of the subsea structure and into the subsea well and being configured to conduct optical signals for sensing data associated with the subsea well, wherein the subsea probe comprises an interface in communication with the fiberoptic line, the interface being configured to communicate the optical signals with the fiberoptic line; and wherein the interface comprises a wet mate fiberoptic connector of a hydraulic probe release stab disposed on the subsea probe.

21. A process for sensing in a subsea well, the process comprising:

mounting a subsea structure in communication with the subsea well, the subsea structure including a subsea probe and defining a bore and at least one flow channel, the bore defined through the subsea structure and communicating the subsea probe with the subsea well, the at least one flow channel communicating with a channel area in the bore;

connecting at least one downline to the at least one flow channel;

releasing a deployable fiberoptic line from the subsea probe to pass through the bore and into the subsea well;

acquiring data associated with the subsea well by conducting optical signals through the deployable fiberoptic line deployed in the subsea well; and after acquiring the data, shearing the deployable fiberoptic line in the bore by closing at least one valve positioned in the bore of the subsea structure.

22. The process of claim 21, wherein, for the subsea structure to include the subsea probe, the process comprises releasably connecting a second connector on the subsea probe with a releasable connection to a first connector on the subsea structure, the bore being in communication with the first connector of the subsea structure.

23. The process of claim 22, wherein releasably connecting the second connector with the releasable connection to the first connector comprises inserting a housing of the subsea probe into the bore of the subsea structure, the housing being releasable from the subsea probe and having the deployable fiberoptic line connected thereto.

24. The process of claim 22, further comprising retrieving the subsea probe from the subsea structure by disconnecting the releasable connection of the second connector from the first connector.

25. A process for sensing in a subsea well, the process comprising:

mounting a subsea structure in communication with the subsea well, the subsea structure including a subsea probe and defining a bore and first and second flow channels, the subsea probe having a deployable fiberoptic line, the bore defined through the subsea structure and communicating the subsea probe with the subsea well, the first and second flow channels communicating with a channel area in the bore;

connecting first and second downlines respectively to the first and second flow channels;

releasably connecting a second connector on the subsea probe with a releasable connection to a first connector on the subsea structure, the bore being in communication with the first connector of the subsea structure;

before releasing the deployable fiberoptic line from the subsea probe, pressure testing the releasable connection of the second connector to the first connector by:

closing a first control valve on the first flow channel connected to the first downline;

opening a second control valve on the second flow channel connected to the second downline;

delivering fluid from the second downline to the channel area of the bore via the second flow channel;

preventing the delivered fluid in the bore from passing to the subsea well; and communicating the delivered fluid in the bore through a lubricator line communicating a first location in the bore between the first connector and the channel area with a second location in the first flow channel upbore of the first control valve;

releasing the deployable fiberoptic line from the subsea probe to pass through the bore and into the subsea well; and acquiring data associated with the subsea well by conducting optical signals through the deployable fiberoptic line deployed in the subsea well.

26. The process of claim 25, wherein, after acquiring the data, the process shearing the deployable fiberoptic line in the bore by closing at least one valve positioned in the bore of the subsea structure.

27. A process for sensing in a subsea well, the process comprising:

mounting a subsea structure in communication with the subsea well, the subsea structure including a subsea probe and defining a bore and first and second flow channels, the subsea probe having a deployable fiberoptic line, the bore defined through the subsea structure and communicating the subsea probe with the subsea well, the first and second flow channels communicating with a channel area in the bore;

connecting first and second downlines respectively to the first and second flow channels;

before releasing the deployable fiberoptic line from the subsea probe, flushing the bore of the subsea structure by:

closing a first control valve in the first flow channel connected to the first downline;

opening a second control valve in the second flow channel connected to the second downline;

delivering fluid from the second downline to the channel area of the bore via the second flow channel;

preventing the delivered fluid in the bore from passing to the subsea well; and communicating the delivered fluid in the bore through a lubricator line communicating a first location in the bore between the subsea probe and the channel area with a second location in the first flow channel upbore of the first control valve;

releasing the deployable fiberoptic line from the subsea probe to pass through the bore and into the subsea well; and acquiring data associated with the subsea well by conducting optical signals through the deployable fiberoptic line deployed in the subsea well.

28. The process of claim 27, wherein preventing the delivered fluid in the bore from passing to the subsea well comprises closing at least one valve disposed in the bore downbore of the channel area.

29. A process for sensing in a subsea well, the process comprising:

mounting a subsea structure in communication with the subsea well, the subsea structure including a subsea probe and defining a bore and at least one flow channel, the subsea probe having a deployable fiberoptic line, the bore defined through the subsea structure and communicating the subsea probe with the subsea well, the at least one flow channel communicating with a channel area in the bore;

connecting at least one downline to the at least one flow channel;

releasing the deployable fiberoptic line from the subsea probe to pass through the bore and into the subsea well by at least one of:

releasing a housing, connected to the deployable fiberoptic line, from the subsea probe to fall through the bore and into the subsea well;

unspooling the deployable fiberoptic line from the housing as the housing and the deployable fiberoptic line pass through the bore and into the subsea well; and unspooling the deployable fiberoptic line from the subsea probe as the housing and the deployable fiberoptic line pass through the bore and into the subsea well; and acquiring data associated with the subsea well by conducting optical signals through the deployable fiberoptic line deployed in the subsea well.

30. The process of claim 21, wherein acquiring the data associated with the subsea well by conducting the optical signals through the deployable fiberoptic line deployed in the subsea well comprises transmitting the optical signals through a lead in communication with the subsea probe, transmitting the optical signals with a remotely-operated vehicle in communication with the subsea probe, or storing the acquired data in a subsea data acquisition unit.

* * * * *